United States Patent [19]

Meatto et al.

[11] Patent Number: 4,639,009

[45] Date of Patent: Jan. 27, 1987

[54] SNOW SKI WITH ELASTOMERIC SIDEWALLS

[75] Inventors: Franklin D. Meatto, Cromwell; Edward D. Pilpel, Avon, both of Conn.

[73] Assignee: Olin Corporation, Cheshire, Conn.

[21] Appl. No.: 814,832

[22] Filed: Dec. 30, 1985

[51] Int. Cl.[4] ..... A63C 5/04

[52] U.S. Cl. ..... 280/602; 280/610

[58] Field of Search ..... 280/608, 610, 601, 609, 280/602

[56] References Cited

U.S. PATENT DOCUMENTS

| | | | |
|---|---|---|---|
| 2,995,379 | 8/1961 | Head | 280/11.13 |
| 3,074,732 | 1/1963 | Riha | 280/610 |
| 3,194,572 | 7/1965 | Fischer | 280/11.13 |
| 3,537,717 | 11/1970 | Caldwell | 280/11.13 |
| 3,700,252 | 10/1972 | Schultes | 280/608 |
| 3,736,609 | 6/1973 | Saucier | 280/610 |
| 3,790,184 | 2/1974 | Bandrowski | 280/610 |
| 3,844,576 | 10/1974 | Schultes | 280/11.13 L |
| 3,901,522 | 8/1975 | Boehm | 280/11.13 L |
| 3,944,239 | 3/1976 | Hastings et al. | 280/608 |
| 4,068,861 | 1/1978 | Zemke, Jr. | 280/608 X |
| 4,300,786 | 11/1981 | Alley | 280/602 |

*Primary Examiner*—Nancy Swisher

*Attorney, Agent, or Firm*—Ralph D'Alessandro; Thomas P. O'Day

[57] ABSTRACT

An alpine ski with flexible impact absorbing edges and elastomeric sidewalls is provided to enable the bottom edges to follow the contour of the ground by moving therealong and absorbing the unevenness of the ground.

13 Claims, 7 Drawing Figures

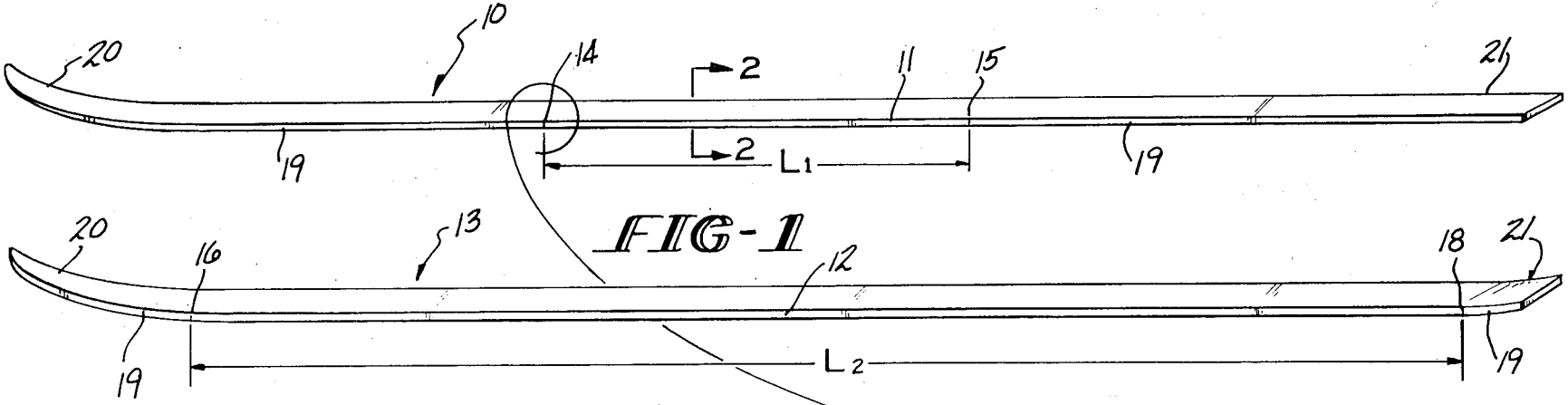
FIG-1
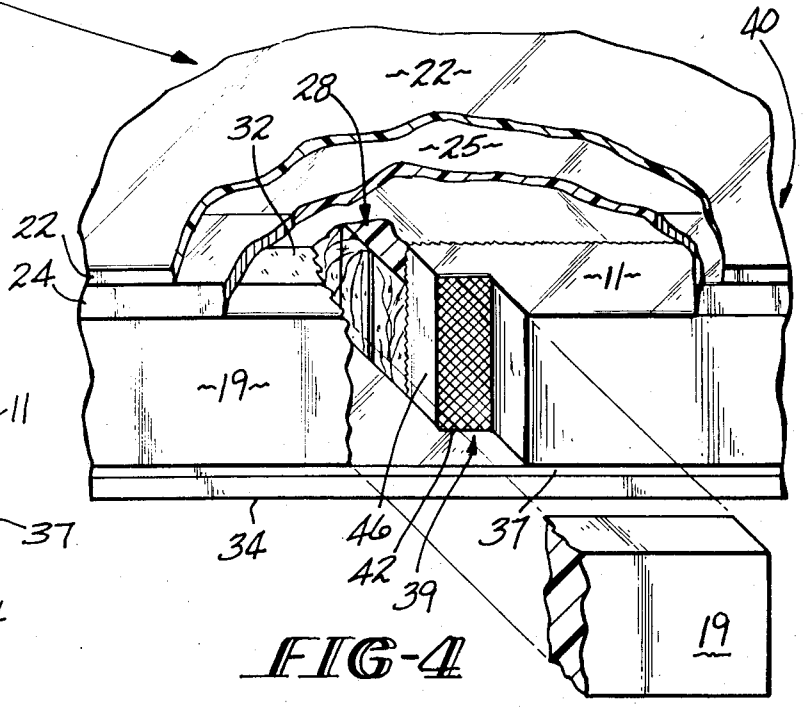
FIG-3
FIG-4
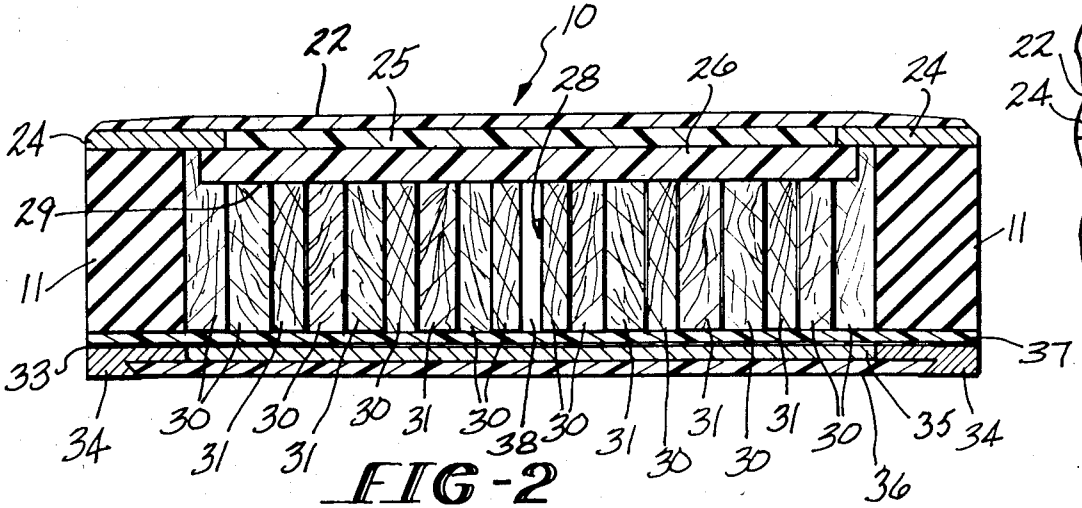
FIG-2

SNOW SKI WITH ELASTOMERIC SIDEWALLS

BACKGROUND OF THE INVENTION

This invention relates to a ski structure, and more specifically, it is concerned with the impact absorbing edges used in conjunction with elastomeric sidewalls used on alpine skis to maximize snow surface contact by the bottom edges of the skis.

The continued popularity of downhill skiing has focused attention on the structure of skis to produce a ski that provides greater responsiveness to the improved skiing techniques being employed by skiers today and the increased speed being achieved as a result of these techniques. Attempting to maintain this continued popularity, the materials used in skis have been changed to develop higher performance skis with lower manufacturing costs. Higher performance levels are especially important to alpine skiers when carving turns at high speeds. This is primarily a factor with racers and advanced skiers where constant control of the skis at high speeds is essential.

High speed skiing requires that the ski, and more particularly the bottom ski edges, remain in contact with the snow surface, especially during turns. It has previously been felt that vibration within the skis must be controlled to increase the hold of the ski edges on ice and snow and to reduce "chatter" in the skis, that is, the loss of contact with the snow-covered ground as the skis move across. Loss of contact of the edges with the snow can cause the ski to slide laterally with respect to the fall line in turns.

One approach to controlling ski vibration deals with dampening the vibrational energy in the skis. Vibrations are created in all skis as they slide across smooth snow-covered ground, the vibrational energy level increasing with greater unevenness of the ground. The natural vibration frequency of skis is relatively low, but the forced vibration frequency of skis traveling over uneven surfaces is quite high. Vibration dampening in ranges covering 50 to 100 cycles per second (cps) and 100 to 300 cps has been commercially employed recently in attempts to prevent the build up of energy within the ski sufficient to cause the ski edges to release contact with the snow-covered ground. This release is believed to be caused by ski contact with the snow-covered ground which creates forced vibrations approaching harmonic frequencies within the ski.

Previous attempts or approaches to dampening the vibration in laminate or multi-layered snow skis have included the use of internal rubber layers and layers of viscoelastic material within the ski and on the top surface of the ski, the latter in combination with a stretch resistant constraining layer. However, all of these approaches either add significantly to the cost of the ski, increase the weight of the ski, and/or reduce the responsiveness and rate of return of the ski.

Another approach to controlling the vibrations in skis maintains that the longitudinal deflection of the ski, not vibration, is the predominant factor which causes the ski edges to release their contact with the snow surface. If the external force or forced deflection can be controlled, it is felt that the ski "chattering" can be controlled. If the impacts from the ground or snow surface to the ski edges are not absorbed by the ski structure, structural vibrations within the ski will commence and the edges will release contact with the snow-covered surface.

The foregoing problems are solved in the design of the present invention by providing an alpine ski structure which uses elastomeric sidewalls in the skis to permit the bottom edges of the ski to flex to absorb external forces while conforming to the shape of the snow-covered ground.

SUMMARY OF THE INVENTION

It is an object of the present invention to provide in an alpine ski a design that maximizes of the amount of time which the bottom edges of the skis spend in contact with the snow covering the surface of the ground, especially during turns.

It is another object of the present invention to provide bottom edges in an alpine ski that are impact absorbing and resilient.

It is a further object of the present invention to provide a design in an alpine ski that permits the bottom edges to conform to the shape of the ground while absorbing the terrain shocks as the ski crosses the ground.

It is a feature of the present invention that the bottom edges of the alpine ski are flexibly affixed to the ski structure.

It is another feature of the present invention that the sidewalls of the alpine ski are elastomeric and deform with the ski edges.

It is still another feature of the present invention that the sidewalls and bottom edges of the alpine ski deform with the terrain as the ski crosses discontinuities in the terrain.

It is yet another feature of the present invention that the elastomeric sidewall has a prepared surface that is knurled to assure bonding to the adjacent ski structure.

It is yet another feature of the present invention that the elastomeric sidewalls extend along at least the central portion of the ski adjacent the core.

It is an advantage of the present invention that the elastomeric sidewalls provide sufficient shock absorption capability so that the alpine ski is less acted upon by external forces and therefore is not driven into vibration or chattering during turns by the discontinuities in the snow surface covering the ground as the ski passes over.

It is another advantage of the present invention that the ski bottom edges stay in contact with the snow to provide greater control of the ski and greater edge hold.

It is still another advantage of the present invention that the bottom edges and elastomeric sidewalls absorb the shocks of the external forces caused by the unevenness of the terrain or the ground.

It is yet another advantage of the present invention that the flexible bottom edges and elastomeric sidewall reduces slippage or lateral sliding of the ski in turns.

These and other objects, features and advantages are obtained by providing an alpine ski with flexible impact absorbing bottom edges and elastomeric sidewalls that permit the bottom edges to conform to the shape of the snow-covered ground to maximize the contact of the bottom edges with the ground while absorbing the shocks or external forces from the discontinuities of the terrain as the ski travels over the snow-covered ground in a prescribed direction.

BRIEF DESCRIPTION OF THE DRAWINGS

The advantages of this invention will become apparent upon consideration of the following detailed disclosure of the invention, especially when it is taken in conjunction with the drawings wherein:

FIG. 1 is a side perspective view of an alpine ski incorporating the elastomeric sidewalls in the area adjacent the core;

FIG. 2 is an enlarged sectional view taken along the lines 2—2 of FIG. 1 showing the binding plate and the elastomeric sidewall;

FIG. 3 is a side perspective view of an alternative embodiment of the alpine ski design employing elastomeric sidewall along the entire contact surface of the ski between the shovel and the tail;

FIG. 4 is an enlarged partial cut away view of the portion of the ski where the elastomeric sidewall meets with the traditional acrylonitrile butadiene styrene sidewall in a lap joint;

DETAILED DESCRIPTION OF THE PREFERRED EMBODIMENT

Figure 5:
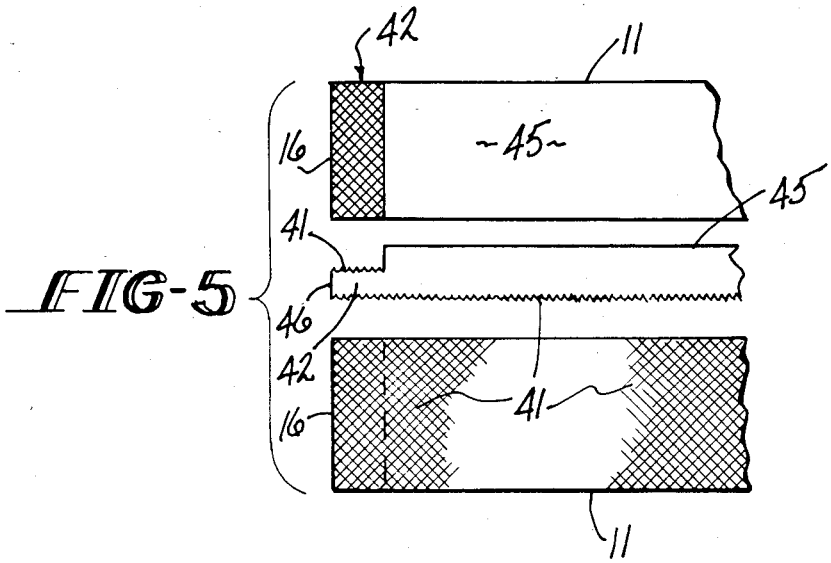
FIG. 5 is a composite view of the top, bottom and side elevational portions of the elastomeric sidewall showing the areas of surface preparation utilized to enhance bonding of the elastomeric sidewall to the adjacent ski structure.

FIGS. 1 and 3 show in side perspective view alpine snow skis, indicated generally by the numerals 10 and 13, with elastomeric sidewall portions 11 and 12, respectively. Only one of the two ski sidewalls is shown in each view. FIG. 1 shows the elastomeric sidewall 11 extending a distance $L_1$ that is generally centered on the contact length of the ski. FIG. 3 shows the elastomeric sidewall 12 extending along the length $L_2$ of the sidewall of the ski 13 generally equivalent to the contact length of the unloaded ski. The front or first ends 14 and 16 and the rear or second ends 15 and 18 of the elastomeric sidewalls are lap jointed with a hard sidewall material 19 that is normally acrylonitrile butadiene styrene (ABS). The skis 10 and 13 have a front area called a shovel 20 and a rear area called a tail 21 at the opposing ends of their longitudinal length.

A representative cross section through the binding plate area of the ski 10 is shown in FIG. 2. This cross sectional view would be the same for ski 13 in the same area. The ski structure is seen as having a hardened top surface 22, generally formed of ABS, that extends across the full width of the ski and overlies a laminate layer 25 formed of unidirectional fiber reinforced plastic. The top edges 24 run the entire length of the ski 10 and may be formed either from plastic or a metal, such as aluminum. Binding plate 26 lies beneath the top laminate layer 25 and is attached to the core, indicated generally by the numeral 28, by a binding foil layer 29.

The top laminate layer 25 of unidirectional fiber reinforced plastic is used only in the binding plate area in conjunction with the binding plate 26 to add screw retention strength to the ski when the bindings are mounted. Outside of the binding area, this layer is replaced by the wood of the core 28.

The binding foil layer 29 compensates for any mismatched tolerances in the wood core 28, as well as providing its principal purpose of increasing the binding pull out strength of the ski. The binding foil layer 29 can be made from any suitable elastomeric material, although rubber or ionomer are preferred. When compressed under the pressure of a press, the rubber or ionomer acts as a film adhesive that helps to bond the laminate layer 25 to the core 28.

Beneath the top edges 24 of FIG. 2 are the elastomeric sidewalls 11 and a portion of the laminated core 28. The core 28 is formed from a plurality of layers of aspen, birch and basswood that are laminated together so that the layers are generally perpendicular to the top surface 22 and the bottom running surface 36. On the outermost portion of the core 28 adjacent the elastomeric sidewalls 11 is a single layer of basswood 32 that acts as a filler, which is partially seen in FIG. 4. Next are two adjacently positioned layers of aspen 30 that are laminated together by an appropriate adhesive. Adjacent these layers of aspen is a layer of birch 31. In alternating sequence, subsequent layers of aspen and birch are also laminated together.

Separating the two interior aspen layers 30 of the wood core 28 is a wedge space 38 that is narrow in the center of the ski 10, but widens as the opposing ends of the ski 10 are approached. Wedge space 38 is a hollow air space into which are emplaced approximately three wedges (not shown) so that the core sticks or alternating layers of aspen and birch can be bent or formed during manufacture of the ski to conform to the sidecut geometry of the ski. It is the sidecut geometry, plus the flexural and torsional patterns of the ski, which defines the turning radius of the ski.

Beneath the core 28 and the elastomeric sidewalls 11 is a layer 37 of woven fiber reinforced plastics that runs the full width and length of the ski. This provides stiffness to the ski. Beneath this layer 37 is a rubber foil layer 33 that also extends across the entire width and length of the ski and helps to bond the bottom edges 34, as well as helping to control the vibrations of the ski 10 during use. Spanning the distance between the opposing bottom edges 34 is an inner bottom laminate layer 35 that is formed of either polyethylene or aluminum. Where aluminum is used a higher natural frequency of the ski 10 is usually obtained. This can facilitate breaking the surface tension or water suction between the bottom running surface 36 of the ski 10 and the snow. Bottom running surface 36 is interior of the bottom edges 34 and is formed of polyethylene. This forms the major contact surface of the ski 10 with the snow.

Bottom edges 24 beneath the rubber foil layer 33 may be either a solid or continuous edge; or a cracked or discontinuous edge along the length of the ski, as desired. It is known that a solid or continuous edge imparts more vibration to the ski 10, keeping all other design factors constant, and permits the surface tension between the bottom surface 36 and the snow to be broken. If the bottom edges 34 are cracked or discontinuous, as is well known in the art, less vibration is transmitted to the ski. Generally, solid or continuous edges are faster and allow the surface tension to be broken more frequently than with cracked or discontinuous edges.

FIG. 4 shows in a partially cut-away and partially exploded view the stepped lap joint 39 of the first end 14 of the elastomeric sidewall 11 with the hard sidewall material 19. The same stepped lap joint is found where the second end 15 of the elastomeric sidewall 11 joins with the hard sidewall material 19 of FIG. 1. Together the elastomeric sidewalls 11 and at least one portion of the hard sidewall material 19 form the sidewalls, a portion of one of which is indicated generally by the numeral 40 in FIG. 4. These composite sidewalls 40 define the lateral side limits between the pair of top edges 24, the layer 37 of woven fiber reinforced plastic, and the bottom edges 34. With the portion of the hard sidewall material 19 moved out of position, it can be seen in FIG. 4 that the stepped lap joint 39 has a surface preparation 41 on two of its surfaces.

Surface preparation 41 is best seen in FIG. 5 as being on the step portion 42 of the elastomeric sidewalls and on the entire surface adjacent the core 28. There is no surface preparation on the sidewall portion that is on the exterior of the ski, shown in the top view of FIG. 5 as surface 45. The surface preparation 41 can be done by prelaminating the elastomeric material 11 to a synthetic support matrix or bonding interface prior to vulcanization, or can be achieved by molding. As shown in FIGS. 4 and 5 the surface preparation appears as knurling. This knurling can also be accomplished by chemically treating the surface to achieve the knurled pattern. The knurling in the surface of the elastomeric material 11 along the interior surface adjacent the core and the step portion 42 creates a surface that permits mechanical bonding to occur between the elastomeric material 11, the adjacent ski structure and the epoxy(not shown) which is used as an adhesive.

The stepped lap joint 39 creates a water tight joint in the sidewall 40 to prevent moisture from entering into the ski's interior between the elastomeric material 11 and the hard sidewall material 19. As can best be seen in FIG. 4, the elastomeric material 11 with its step portion 42 of stepped lap joint 39 seats interiorly of the hard sidewall material 19, while the end of the hard sidewall material 19 abuts against the ajoining surface of the elastomeric material 11. The endwall 46 of step portion 42 abuts against the adjoining surface of the layer of basswood 32 of the core 28.

The characteristics of the elastomeric material 11 can affect the recovery speed of the bottom edges 34 from deformation when crossing an uneven surface. Because the material is elastomeric, it permits the bottom edges 34 to deform upwardly and inwardly when discontinuities in the snow covered surfaces are encountered. This results in a shock absorption effect. The speedy recovery of the bottom edges 34 from their deformation or deflection is affected by the thickness of the elastomeric material 11 or by its hardness or durometer. Generally the thicker the elastomeric material, the slower the rebound resilience period, while decreasing the durometer will have the same effect. The speed of recovery is increased by decreasing the thickness of the elastomeric material, but some of the load absorbing capability of the structure is sacrificed. The thickness of the elastomeric material can vary from $\frac{1}{4}$ to $\frac{3}{8}$ of an inch.

The durometer of the elastomeric material 11 ranges from 40A to a 55D durometer, as determined by a Shore Scleroscope. A 40A durometer is generally softer and will decrease the rebound resilience period.

Elastomeric material as discussed in this application is intended to encompass the class of substances which stretch under tension, have a high tensile strength, retract rapidly, and recover their original dimensions fully. These include natural rubber; homopolymers such as polychlorobutadiene, polybutadiene and polyisoprene; copolymers such as styrene-butadiene rubber, butyl rubber, nitrile rubber, ethylene-propylene copolymers, fluorine elastomers and polyacrylates; polycondensation products such as polyurethanes, silicone rubber and polysulfide rubber; and chemically converted high polymers such as halogen substituted rubber. These substances are acceptable as long as they sufficiently weather ultraviolet light rays and are stable with large temperature changes. For example, the durometer must not change more than 15 points on the Shore Scleroscope between room temperature and −20° F.

Also affecting the recovery ability of the bottom edges 34 is the cantilever beam effect that is provided by the layer 37 of woven fiber reinforced plastic to which the bottom edges 34 are bonded. This layer 37 experiences transverse loading which requires transverse reinforcing glass fibers. Discontinuities in the ground over which the bottom edges 34 pass creates a cantilever effect which, in combination with the deformability of the elastomeric sidewall material 11, permits the bottom edges 34 to move upwardly and somewhat inwardly in a predetermined arc.

Figure 6:
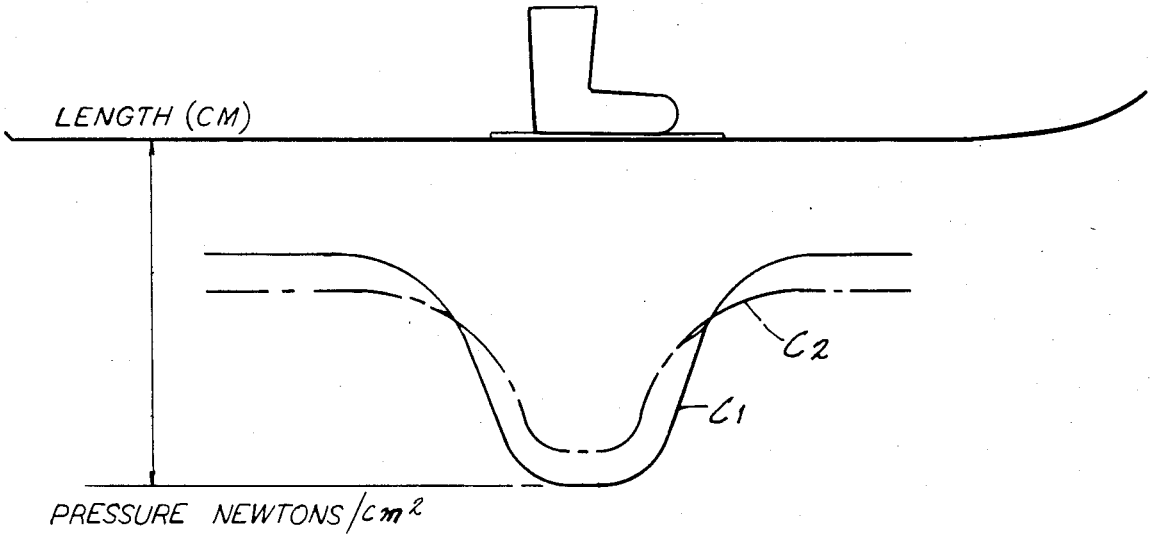
FIG. 6 is a graphical illustration of the effect of forced deflection on a ski in the area of the core beneath the ski boot and the distribution of the loading along the length of the ski.

FIG. 6 shows an illustration of how the placement of the elastomeric sidewalls 11 and 12 of FIGS. 1 and 3 along the lateral side limits of the ski positions these flexible bottom edges 34 directly below the center of gravity of the skier, the location of highest pressure distribution, to permit the bottom edges 34 to adapt or deform in response to the terrain. The pressure on the bottom inside edges 34 of the downhill ski in a turn across the fall line as they deform is shown in FIG. 6 as being distributed toward the shovel 20 and the tail 21 of the ski. FIG. 6 shows in curve $C_1$ how the pressure load is centralized beneath the skier in the cental area of the ski on the skis not employing flexible bottom edges 34 in combination with the elastomeric sidewalls 11 or 12. Curve $C_2$ shows how the pressure load is more evenly distributed toward the extremities of the ski 10 so that the load directly beneath the center of gravity of the ski is reduced on skis employing elastomeric sidewall material 11. This creates a more desirable even distribution of the pressure that results in an increased bottom edge holding capability and a shortening of the arc of the turn of the ski with less skier input.

Figure 7:
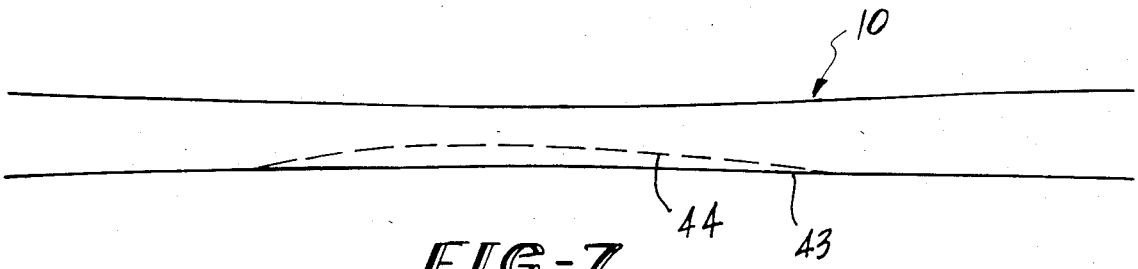
FIG. 7 is a partial top plan illustration of the normal angle of curvature of the sidecut of a ski beneath the center of gravity of the skier and the effect of the flexible bottom edges and the deformable ski sidewalls on the adjustability of the angle of curvature of the side cut that serves to transfer the skier's force to the contact extremities of the ski and to reduce the skiing radius in a turn.

FIG. 7 shows the effect on the curvature of the sidecut of the ski 10 by the ability of the inside bottom edges 34 of a ski in a turn to deform with the elastomeric sidewalls 11 or 12. The ski 10 is shown in illustrative form with the curvature of the sidecut of the unstressed ski shown in solid lines. Line 43 represents the unstressed bottom edge, while dotted line 44 shows how the inside bottom edges 34 can deform and change the curvature of the sidecut of a ski in a turn to create a shortened turning arc by decreasing the radius of the curvature of the sidecut in the ski 10 during the turn.

FIGS. 6 and 7 illustrate how the structure of skis 10 and 13 respond to forced deflection of the ski by allowing the bottom edges 34 to move upwardly and absorb the unevenness of the terrain without restricting the recovery of the deflection of the ski along its longitudinal length. The distribution of the pressure loading on the ski toward its extremities permits the skis to bite or dig into the snow surface during a turn to help complete the turn with a smaller turning radius.

While the preferred structure in which the principles of the present invention have been incorporated is shown and described above, it is to be understood that the invention is not to be limited to the particular details thus presented but, in fact, widely different means may be employed in the practice of the broader aspects of this invention. The scope of the appended claims is intended to encompass all obvious changes in the details, materials and arrangements of parts that will occur to one of ordinary skill in the art upon a reading of this disclosure.

Having thus described the invention, what is claimed is:

1. An alpine snow ski for skiing across snow covered ground, the ski being of selected length with a contact length intermediate the shovel and the tail and having a binding area beneath where the center of gravity of a skier on the ski is located, comprising in combination:

(a) a bottom running surface;

(b) a pair of bottom edges flexibly mounted to the bottom running surface defining the lateral side limits of the ski along the bottom running surface;

(c) a core positioned above the bottom running surface and intermediate the lateral side limits of the ski;

(d) a plurality of generally horizontally positioned laminate layers below the core and above the bottom running surface and above at least a portion of the core;

(e) a top surface layer extending generally horizontally between the lateral side limits of the ski overlying the core and at least one of the plurality of generally horizontally positioned laminate layers above at least a portion of the core;

(f) a pair of top edges defining the lateral side limits of the top of the ski, the top edges being positioned above the core and beneath the top surface layer; and (g) a pair of sidewalls extending along the selected length of the ski and between at least a portion of the lateral side limits of the pair of top edges and the bottom edges, the pair of sidewalls being formed at least partially of an elastomeric material and a second sidewall material, the elastomeric material being within the contact length, but extending a distance less than the selected length of the ski and including at least an area generally alongside the binding area where the center of gravity of a skier is located to permit the bottom edges to flex upwardly to absorb shock as the bottom running surface passes over snow covered ground.

2. The ski according to claim 1 wherein the elastomeric material extends along the pair of sidewalls for at least a portion of the contact length of the ski.

3. The ski according to claim 2 wherein the pair of bottom edges are cracked.

4. The ski according to claim 2 wherein the pair of bottom edges are solid.

5. The ski according to claim 2 wherein the elastomeric material has a first end nearest the shovel and a second end nearest the tail, the first end and the second end having stepped portions to fittingly engage with the second sidewall material.

6. The ski according to claim 5 wherein the first end and the second end of the elastomeric material are adjacent the second sidewall material, the stepped portions fitting interiorly under the second sidewall material.

7. The ski according to claim 6 wherein the elastomeric material has an interior surface and stepped surface portions, the interior surface and stepped surface portions being roughened to promote good bonding.

8. The ski according to claim 7 wherein the plurality of generally horizontally positioned laminate layers below the core and above the bottom running surface comprises an aluminum bottom layer adjacent and between the pair of bottom edges, a layer of rubber foil overlying the aluminum bottom layer, and a layer of fiber reinforced plastic overlying the layer of rubber foil and underlying the core.

9. The ski according to claim 8 wherein the plurality of generally horizontally positioned laminate layers above at least a portion of the core comprises a binding foil layer and a layer of unidirectional fiber reinforced plastic adjacent and between the pair of top edges.

10. The ski according to claim 9 wherein the binding foil layer and the layer of unidirectional fiberglass are separated by a binding plate over a portion of the selected length of the ski.

11. The ski according to claim 1 wherein the ski has a curvature of the sidecut along the lateral side limits that increases when one of the pair of the bottom edges on the uphill side deforms inwardly with respect to the core from contact with the snow covered ground in a turn.

12. In an alpine snow ski having a shovel and a tail, a pair of bottom edges adjacent a bottom running surface and a pair of sidewalls forming a curvature of the sidecut of the ski along the lateral side limits, the ski further being of a selected length with a contact length intermediate the shovel and the tail, the improvement comprising in combination;

(a) the pair of sidewalls being formed at least partially along the contact length of an elastomeric material and a second sidewall material to form a composite sidewall, said second sidewall material and said elastomeric material having at least one stepped portion fitting beneath and interiorly to engage the second sidewall material;

(b) a pair of bottom edges flexibly connected to the bottom running surface, at least the bottom edges on the uphill side flexing upwardly with the elastomeric material in a turn to absorb shock as the bottom running surface passes over snow covered ground to increase the curvature of the sidecut of the ski so that the shovel and the tail dig into the snow permitting a sharper turn with a smaller radius to be effected.

13. The ski according to claim 12 wherein the second sidewall material is acrylonitrile butadiene styrene.

* * * * *